US010228132B2

(12) United States Patent
Radl

(10) Patent No.: US 10,228,132 B2
(45) Date of Patent: Mar. 12, 2019

(54) SYSTEM FOR OPTIMIZING AIR BALANCE AND EXCESS AIR FOR A COMBUSTION PROCESS

(71) Applicant: Brad Radl, Chardon, OH (US)

(72) Inventor: Brad Radl, Chardon, OH (US)

( * ) Notice: Subject to any disclaimer, the term of this patent is extended or adjusted under 35 U.S.C. 154(b) by 424 days.

(21) Appl. No.: 14/612,363

(22) Filed: Feb. 3, 2015

(65) Prior Publication Data

US 2015/0301535 A1 Oct. 22, 2015

Related U.S. Application Data

(60) Provisional application No. 61/934,885, filed on Feb. 3, 2014.

(51) Int. Cl.

| | |
|---|---|
| ***G05D 7/06*** | (2006.01) |
| ***F23N 3/00*** | (2006.01) |
| ***F23N 5/00*** | (2006.01) |
| ***F23N 5/24*** | (2006.01) |

(52) U.S. Cl.

CPC ..... *F23N 3/002* (2013.01); *F23N 5/003* (2013.01); *F23N 5/006* (2013.01); *F23N 5/242* (2013.01); *F23N 2037/28* (2013.01); *F23N 2041/10* (2013.01); *F23N 2900/05001* (2013.01)

(58) Field of Classification Search

CPC ..... F23N 2900/05001; F23N 2037/28
USPC ..... 700/282, 274
See application file for complete search history.

(56) References Cited

U.S. PATENT DOCUMENTS

| | | | | |
|---|---|---|---|---|
| 4,994,959 | A * | 2/1991 | Ovenden | F23N 1/022 236/15 BD |
| 5,167,009 | A | 11/1992 | Skeirik | |
| 5,520,123 | A * | 5/1996 | Chappell | F23G 5/165 110/185 |
| 6,055,524 | A | 4/2000 | Cheng | |
| 6,712,604 | B2 * | 3/2004 | Havlena | F23N 1/02 431/12 |
| 6,739,122 | B2 | 5/2004 | Kitajima et al. | |
| 7,756,591 | B2 | 7/2010 | Jia et al. | |
| 8,910,478 | B2 | 12/2014 | Cheng et al. | |
| 2004/0191914 | A1 * | 9/2004 | Widmer | F23N 1/022 436/55 |

(Continued)

OTHER PUBLICATIONS

"Supplemental Documentation on the Menta PID blocks" May 21st, 2010, accessed at http://buildingskb.schneider-electric.com/view.php?AID=3890.*

(Continued)

*Primary Examiner* — Emilio J Saavedra
(74) *Attorney, Agent, or Firm* — Clifford H. Kraft

(57) ABSTRACT

A control system for adjusting total air flow or oxygen in flue gas for a fossil fired power generating or steam generating unit, that includes a plurality of sensors that supply data to a tunable controller adapted to sense total air flow and/or oxygen flow; with the sensors also supplying data relating to carbon monoxide (CO) and/or combustibles and/or loss of ignition (LOI) and/or carbon in ash (CIA), and where the tunable controller can set a desired target or target range for at least one of CO, combustibles, CIA, or LOI and adjust the total air flow and/or O2 via direct control or bias signals. The system can respond to discrete events, analog events and/or thresholds.

7 Claims, 3 Drawing Sheets

Flow Chart 3

(56) References Cited

U.S. PATENT DOCUMENTS

| | | | | |
|---|---|---|---|---|
| 2005/0177340 | A1* | 8/2005 | Draxton | G01N 33/0062 702/182 |
| 2007/0250215 | A1* | 10/2007 | Jia | G05B 13/048 700/274 |
| 2011/0061575 | A1* | 3/2011 | Seeker | F01K 25/06 110/186 |
| 2013/0302738 | A1* | 11/2013 | Rennie | F23N 1/022 431/12 |

OTHER PUBLICATIONS

Honeywell, "ControLinks Fuel Air Ratio Commercial/Industrial Combustion Controls Capable." May 2007, 8 Pgs.*

Wagner, "What's All this "BUMP" Test Stuff About Anyhow?" Oct. 2007, Pollution Equipment News, accessed at http://www.rimbach.com/scripts/article/pen/number.idc?number=124.*

* cited by examiner

Flow Chart 1

Flow Chart 2

Flow Chart 3

SYSTEM FOR OPTIMIZING AIR BALANCE AND EXCESS AIR FOR A COMBUSTION PROCESS

This application claims priority from U.S. provisional patent application No. 61/934,885 filed Feb. 3, 2014. Application 61/934,885 is hereby incorporated by reference in its entirety.

BACKGROUND

Field of the Invention

The present invention relates to a system for optimizing air balance and excess air for a combustion process and may also be construed as a CO or combustibles tuner. The O2 is manipulated to maintain a target CO. Inclusion of the O2 balance manager and discrete logic bumps are to reduce alarms for operators. The combination of features is unique to the best of our knowledge, though inverting the treatment of O2 as a disturbance to models is different than the other vendors by itself.

Description of the Prior Art

U.S. Pat. No. 8,910,478, Dec. 16, 2014 Model-free adaptive control of supercritical circulating fluidized-bed boilers. This patent describes a multivariate control system. This is built on a family of patents starting with U.S. Pat. No. 6,055,524, Apr. 25, 2000, Model-free adaptive process control, fundamentally based on artificial neural networks to model the process and then the neural network is used as a direct or reverse acting controller. This involves connective networks to with Strong, Medium and Weak connections among several variables. While process models (per Abstract) are not required, it does require the building and maintenance of a connective mathematical representation of 5 or more signals specific to the supercritical circulating units. Often these are neural networks, but may fall under other terminology, such as connective networks, or multivariate models as used here. The patent also does not explicitly deal with O2 control or how any of the parameters may used as constraints within an optimizer.

The current invention does require the use of such techniques to predict the impact of changes in one variable upon another, although it allows a separate neural network like model to set up air conditions separate from the O2 virtual controller described in this invention. The above invention also will not respond to discrete events, as neural networks in process control are usually, if not always, limited to smooth continuous functions, as neural network math does not had step changes well.

U.S. Pat. No. 7,756,591. Jul. 13, 2010, system for optimizing oxygen in a boiler. This patent describes the use of a predictive model to control the O2. This is similar to the U.S. Pat. No. 6,055,524 family of patents above; though this tracks its pedigree to U.S. Pat. No. 5,167,009 which describe the general use of neural networks for process control. This adds the concept of using the O2 model in an optimizer to determine the O2 as part of the overall system optimization. This invention does not predict the O2, but instead uses indications of combustion efficiency to adjust the O2 values in a feedback loop in real-time. O2 is not optimized through a model—optimizer combination but instead is set up to control the excess air to maintain a target value or target range value for carbon monoxide (or other combustion byproduct indications).

U.S. Pat. No. 6,739,122, May 25, 2004. Air-fuel ratio feedback control apparatus. This patent describes an adaptive controller that uses feedback on NOx values. The description includes the use of O2 in a dynamic gain use. However, a major difference is the specific application of the engine exhaust system (car, truck, etc) and the need for O2 sensors before and after the catalyst. Further, the patent does not include the use of CO for efficiency feedback nor include any discrete logic.

SUMMARY OF THE INVENTION

The present invention relates to a control system for adjusting total air flow or oxygen in flue gas for a fossil fired power generating or steam generating unit, that includes a plurality of sensors that supply data to a tunable controller adapted to sense total air flow and/or oxygen flow; with the sensors also supplying data relating to carbon monoxide (CO) and/or combustibles and/or loss of ignition (LOI) and/or carbon in ash (CIA), and where the tunable controller can set a desired target or target range for at least one of CO, combustibles, CIA, or LOI and adjust the total air flow and/or O2 via direct control or bias signals.

The system is also configured to respond to a discrete event like a mill or burner going into or out of service as sensed through a digital signal, an analog inferential signal converted to digital value or based on threshold values.

The system can also respond to a discrete event comprising an alarm event for O2 average, and/or O2 individual sensors, high combustible signal (individual or average), and/or high CO (individual or average), and/or high CIA or LOI (individual or average), or a sootblowing operation.

Finally, the system can respond to discrete events over a discrete a period of time with a tunable bump up and bump down value and time period for controlling O2 or excess air.

DESCRIPTION OF THE FIGURES

Attention is now directed to several figures that illustrate features of the present invention.

Figure 1:
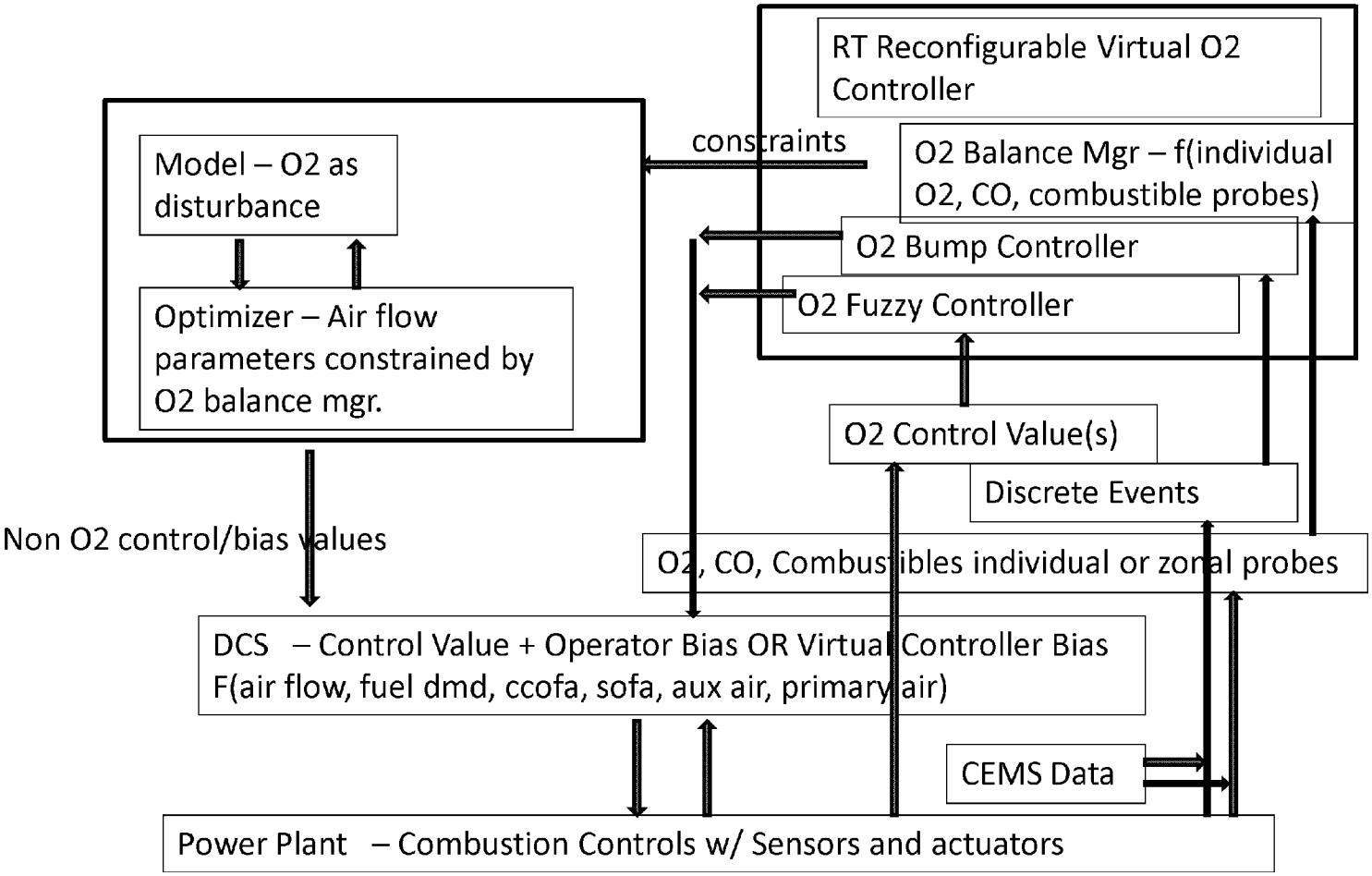
FIG. 1 shows a flowchart for the present invention with an O2 disturbance model.
Figure 2:
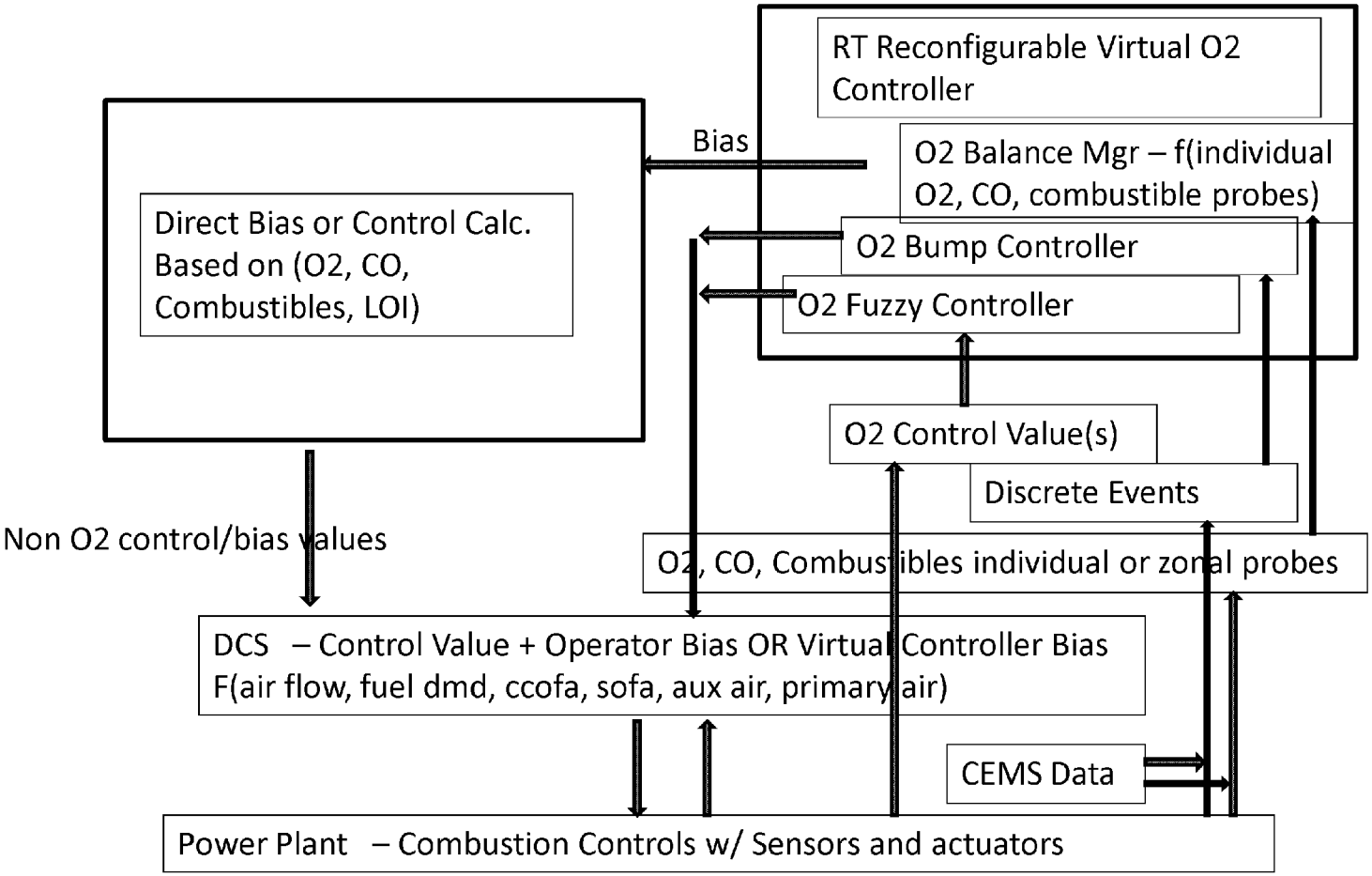
FIG. 2 shows the flowchart of FIG. 1 with a direct bias calculation based on O2, CO, combustibles and LOI).
Figure 3:
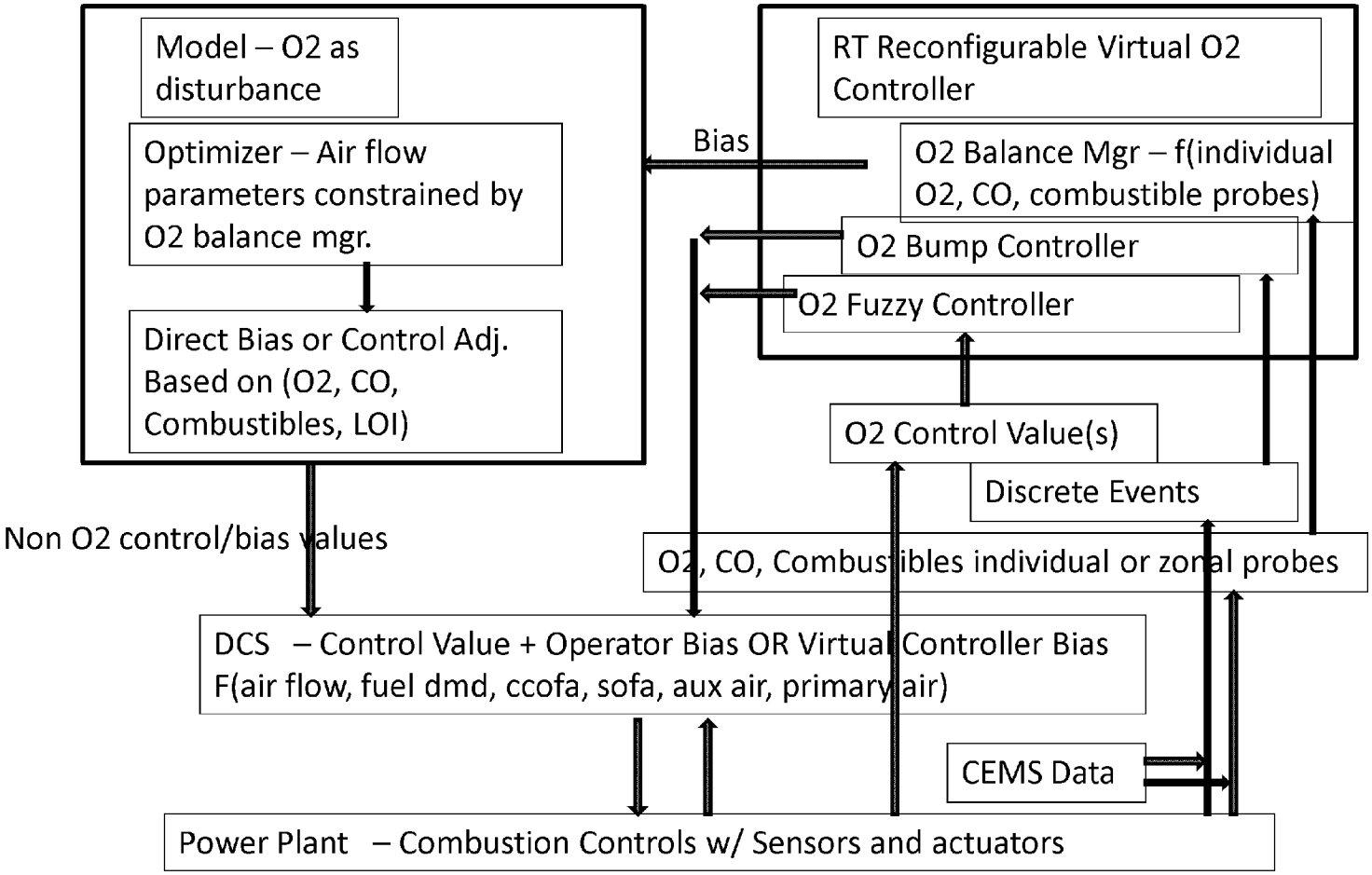
FIG. 3 shows the flowchart of FIG. 1 with an O2 disturbance and direct bias.

Several drawings and illustrations have been presented to aid in understanding the present invention. The scope of the present invention is not limited to what is shown in the figures.

DESCRIPTION OF THE PREFERRED EMBODIMENTS

In the prior art, a model and/or optimizer is typically used to set the O2 value. In the present invention, the O2 value, in particular, the O2 grid (2 or more sensors) in combination with the one or more sensor values indicating incomplete combustion are used to dynamically modify the constraints of said system. The O2 is treated as a disturbance variable and not a control variable.

The present invention can also bypass any model—optimizer combination directly and adjust any number and any combination of air dampers to achieve either a target O2 value or target difference between O2 probes, and/or probes indicating incomplete combustion. In this invention, the feedback adjusts the constraints of the model-optimizer such that other variables such as air dampers are constrained to a new range of operation.

Finally, unique is the ability to use discrete events and merge this with the above control strategies, including, but not limited to:

a) A pulverizer mill going into or out of service, as indicated by a DCS digital signal, or through conversion of an analog into a discrete signal (IF mill speed<35:Mill=OFF).
b) A sootblower starting and/or stopping.
c) An O2 or CEMS signal (e.g. CO, combustibles, LOI) that has an alarm or other discrete trigger in the DCS, or through conversion of an analog into a discrete signal (i.e. O2 probe A2<1.7%, low O2 alarm).

Any of these events can cause a response of bumping the O2 control signal or bias by a discrete amount, for example 0.2%. Usually after a time period, set by the user to approximate the duration of the process upset, the O2 is 'bumped down', usually at a value less than the bump up, for example 0.1% in this case.

They would all work in combination with a 'fuzzy controller', that continually looks at an indication incomplete combustion, such as CO and will trim the O2 controller either directly or through a bias to keep CO in a 'control range'. For example, if the CO is desired to be less than 150 ppm for compliance purposes, the user may set the controller to keep CO between 50 and 150 ppm. Therefore if the CO drops below 50 ppm, the bias will become more negative. If the CO is above 150 ppm, the bias becomes more positive. In both cases, the further away from the target value, the bias movement may be increased.

The O2 balance manager, O2 fuzzy controller, and O2 bump controller may operate on independent frequencies. The O2 fuzzy controller and O2 bump controller will work on an additive basis, such that the O2 bump controller may cause a bump in O2 value, which if too much, results in a low CO, triggering to the fuzzy controller to slowly ramp the O2 signal back down. The O2 balance manager, through eliminated pockets of low O2, generally lowers the CO, resulting in the fuzzy controller being able to lower the O2. This may operate with or without a neural network model and optimizer combination.

All this is embedded in a graphical programming environment (GPE) so each controller is virtual (software only) and easily tuned in real-time. The output is connected to the DCS for the normal PID O2 control response.

O2 Control in the present invention is a combination of artificial intelligence (AI) and conventional control techniques. Users may set up the system to utilize one or more of the techniques, with the most common setup for the invention being to utilize the O2 Fuzzy Controller to control the baseline O2 level (generally through the bias), the O2 Bump Controller to respond to discrete events and/or an O2 Balance Manager (a.k.a. Controller) that impacts damper settings either directly and/or through updated constraints to model/optimizer combination to reduce O2 splits (i.e. deviations between probes, furnace sides, furnace O2 average values, or other grid elements measuring O2).

The O2 Bump Controller allows the O2 bias to respond to events and anticipate the need to increase O2 and avoid or trim periods of high CO, combustibles or other poor combustion conditions.

The O2 Fuzzy Controller which is a trim to the O2 bias in response to combustion conditions—normally an average CO value.

The controller keeps the O2 in the desired range, only adjusting when outside the range; and generally making adjustments in increasingly larger increments as the deviation from desired conditions increases.

The O2 Balance Manager (a.k.a. Controller) works to manage air distribution through movement or constraints on movements of air dampers, such as, auxiliary air, fuel air and/or over-fire/under-fire air. The balancer may directly move a damper based on input values for O2, CO, combustibles or other combustion indicators or it may alter constraints to a model/optimizer logic circuit allowing other targets such as NOx (nitrogen oxides) to be optimized within the new constraint ranges.

All the above controllers are programmed through an Open System Toolkit, requiring no programming, compiling, assembly or other traditional software methods for executing code on a computing device. The Graphical User Interface allows all programming steps, data display, data import/export and communication to happen through graphical elements.

Several descriptions and illustrations have been provided to aid in understanding the present invention. On with skill in the art will realize that numerous changes and variations may be made without departing from the spirit of the invention. Each of these changes and variations is within the scope of the present invention.

I claim:

1. A control system for adjusting total air flow or oxygen (O2) in flue gas for a fossil fired power generating or steam generating unit, comprising:

a plurality of sensors located in the flue gas coupled to a tunable controller adapted to read at least one of the sensors in order to measure total air flow and/or oxygen flow in the flue gas;

at least one of said plurality of sensors also measuring levels of carbon monoxide (CO) and/or combustibles and/or loss of ignition (LOI) and/or carbon in ash (CIA) in the flue gas;

the tunable controller adapted to set a desired target or target range for at least one of CO, or combustibles, CIA, in the flue gas, the tunable controller using an O2 balance manager, O2 fuzzy controller and O2 bump controller;

the tunable controller comprising:

said O2 bump controller that causes an increase in O2 bias by a predetermined amount triggered by periods of high CO or CIA followed after a predetermined duration by a decrease in O2 bias, wherein the decrease is less than the increase; and said O2 fuzzy controller which trims O2 bias in response to an average CO value; said O2 fuzzy controller keeping O2 in a desired range and only adjusting O2 bias when O2 is outside the range; the O2 fuzzy controller making adjustments in increasingly larger increments as deviation from the desired range increases; and said O2 balance manager adapted to manage air distribution through movement of air dampers; wherein, the O2 balance manager directly moves one or more dampers based on input values for O2, CO, combustibles from one or more of the sensors;

wherein, said tunable controller means adjusts the total air flow and/or O2 via direct control or bias signals and, wherein the tunable controller is configured to respond to a discrete event comprising a mill, sootblower or burner going into or out of service as sensed through a digital signal; and, wherein the controller adapted to simultaneously compute a balance between O2, CO, air damper settings and windbox differential pressure; and, wherein the O2 balance manager, O2 fuzzy controller, and O2 bump controller operate-independently from one-another; and, wherein the tunable controller is configured to alter the air balance in order to balance combustion indication terms by directly altering air flow at any entry point into a combustion and post combustion zone either through constraints sent to a model/optimization system or by direct biasing or control of output values based on imbalance functions.

2. A control system according to claim 1 wherein the tunable controller means is configured to respond to a discrete event comprising a mill, sootblower or burner going into or out of service as sensed by the controller through an analog inferential signal converted to digital value.

3. A control system according to claim 1 wherein the tunable controller means is configured to respond to a discrete event comprising a mill, sootblower or burner going into or out of service based on threshold values.

4. A control system according to claim 1 wherein the tunable controller means is configured to respond to a discrete event comprising an alarm event for O2 average, and/or O2 individual sensors, high combustible signal and/or high CO, and/or high CIA or LOI.

5. A control system according to claim 1 wherein the tunable controller means is configured to respond to a discrete event comprising a sootblowing operation.

6. A control system according to claim 1 wherein the tunable controller means is configured to respond to discrete events over a discrete a period of time with a tunable bump up and bump down value and time period for controlling O2 or excess air.

7. The control system of claim 1 where the system is virtual and can be reconfigured to add and delete features without need to for compiling, assembling or restart of computers or controllers.

* * * * *